US009675165B2

(12) United States Patent
Lee et al.

(10) Patent No.: US 9,675,165 B2
(45) Date of Patent: Jun. 13, 2017

(54) BACKPACK FRAME DEVICE

(71) Applicants: Seowon Lee, Busan (KR); Chanyoung Kim, Seoul (KR); Sungwan Kim, Busan (KR)

(72) Inventors: Seowon Lee, Busan (KR); Chanyoung Kim, Seoul (KR); Sungwan Kim, Busan (KR)

( * ) Notice: Subject to any disclaimer, the term of this patent is extended or adjusted under 35 U.S.C. 154(b) by 101 days.

(21) Appl. No.: 14/771,467

(22) PCT Filed: Feb. 11, 2015

(86) PCT No.: PCT/KR2015/001382
§ 371 (c)(1),
(2) Date: Aug. 28, 2015

(87) PCT Pub. No.: WO2015/126094
PCT Pub. Date: Aug. 27, 2015

(65) Prior Publication Data

US 2016/0000212 A1 Jan. 7, 2016

(30) Foreign Application Priority Data

Feb. 19, 2014 (KR) ..... 10-2014-0018945

(51) Int. Cl.
*A45F 5/00* (2006.01)
*A45F 3/08* (2006.01)
(Continued)

(52) U.S. Cl.
CPC ..... *A45F 5/00* (2013.01); *A45F 3/08* (2013.01); *A45F 3/10* (2013.01); *A45F 3/12* (2013.01)

(58) Field of Classification Search
CPC ..... A45F 5/00; A45F 3/08; A45F 3/10; A45F 3/12
(Continued)

(56) References Cited

U.S. PATENT DOCUMENTS 640,880 A * 1/1900 Dawson et al. ..... A45B 11/02 224/189
2,223,253 A * 11/1940 Hamilton ..... A45B 11/02 135/98
(Continued)

FOREIGN PATENT DOCUMENTS

| | | |
|---|---|---|
| CA | 2040617 C | 1/1995 |
| CN | 101744450 A | 6/2010 |
| KR | 200292644 Y1 | 10/2002 |

OTHER PUBLICATIONS

International Search Report for PCT/KR2015/001382 mailed on Apr. 21, 2015.
(Continued)

*Primary Examiner* — Peter Helvey
(74) *Attorney, Agent, or Firm* — Hauptman Ham, LLP

(57) ABSTRACT

The backpack frame device includes back frames mutually spaced apart and connected, shoulder frames which include one ends coupled with the back frames and the other ends extending over shoulders of a user toward a rear of the waist of the user, supporting pads which are hinge-coupled with bottom ends of the back frames and include top ends opposite to the bottom ends and which are configured to support parts of the shoulder frames, shoulder mounted pads which are coupled with the shoulder frames and elastically pressurize both shoulders of the user, and a lumbar support which is coupled with the bottom ends of the shoulder frames and supports the rear of the waist of the user.

14 Claims, 9 Drawing Sheets

(51) Int. Cl.
*A45F 3/12* (2006.01)
*A45F 3/10* (2006.01)

(58) Field of Classification Search
USPC ..... 224/189, 633
See application file for complete search history.

(56) References Cited

U.S. PATENT DOCUMENTS 4,256,007 A * 3/1981 Streit ..... G10G 5/005 224/910
4,369,903 A 1/1983 Wilkes
4,402,441 A * 9/1983 Jones ..... G10G 5/005 224/265
4,453,442 A * 6/1984 LaFlame ..... G10G 5/005 224/910
4,484,700 A * 11/1984 Bush ..... A47D 13/025 224/159
4,634,032 A * 1/1987 LaFlame ..... G10G 5/005 224/265
5,400,683 A * 3/1995 LaFlame ..... G10G 5/005 224/265
6,626,342 B1 * 9/2003 Gleason ..... A45F 3/08 224/633
2011/0108595 A1 5/2011 Hoag
2011/0198377 A1 * 8/2011 Froidevaux ..... A45F 3/08 224/633
2016/0037895 A1 * 2/2016 Humphreys ..... A45F 3/08 224/633
2016/0106199 A1 * 4/2016 Hairston ..... A45F 3/08 224/633
2017/0035187 A1 * 2/2017 Chapman ..... A45F 3/10

OTHER PUBLICATIONS

Extended European Search Report dated Jan. 16, 2017 from European Patent Office in connection with the counterpart European patent application No. 15750910.0.

* cited by examiner

BACKPACK FRAME DEVICE

CROSS REFERENCE TO RELATED APPLICATION

This application claims the priority of Korean Patent Application No. 10-2014-0018945 filed on Feb. 19, 2014 in the Korean Patent and Trademark Office. Further, this application is the National Phase application of International Application No. PCT/KR2015/001382filed on Feb. 11, 2015, which is incorporated herein by reference in its entirety.

TECHNICAL FIELD

The present invention relates to a backpack frame device, and more particularly, to a backpack frame device capable of preventing rucksack palsy by distributing the load on the shoulders using a frame and a back without shoulder straps and allowing a correct posture to be maintained even when a heavy backpack is carried.

BACKGROUND ART

Generally, backpacks used for climbing or traveling each typically include a backpack body which stores objects and shoulder straps which are attached to the backpack body and go over user's shoulders.

Recently, a technology of preventing a heavy load from being applied to the back even when a lot of objects are stored in a backpack body by mounting shoulder straps on a firm back plate has been developed.

However, when a user has a backpack in which heavy objects are stored on his or her back with straps, the heavy load is concentrated on the straps. Accordingly, rucksack palsy may occur. Also, when the user has moved for a long time with an incorrect posture caused by the heavy weight, the user's body has many occurring problems.

DISCLOSURE

Technical Problem

The present invention provides a backpack frame device capable of increasing comfort for a user by distributing the load of a backpack using a frame instead of shoulder straps, correcting a posture of the user using the backpack, and coupling an additional backpack by changing a structure of the backpack.

Technical Solution

One aspect of the present invention provides a backpack frame device including back frames mutually spaced apart and connected, shoulder frames which include one ends coupled with the back frames and other ends extending over shoulders of a user toward a rear of the waist of the user, supporting pads which are hinge-coupled with bottom ends of the back frames and include top ends opposite to the bottom ends and configured to support parts of the shoulder frames, shoulder mounted pads which are coupled with the shoulder frames and elastically pressurize both shoulders of the user, and a lumbar support which is coupled with the bottom ends of the shoulder frames and supports the rear of the waist of the user.

The backpack frame device may further include buffer members whose one ends are coupled with the supporting pads and the other ends opposite to the one ends are coupled with the back frames.

The shoulder frames may include first shoulder frames hinge-coupled with the back frames and second shoulder frames hinge-coupled with the first shoulder frames, and the second shoulder frames are coupled with the lumbar support.

The supporting pads may include first supporting pad portions coupled with the back frames and second supporting pad portions formed on parts of the first supporting pad portions in contact with the back to provide cushioning properties.

The supporting pads may include a left supporting pad portion which surrounds a left shoulder and a left waist of the user and a right supporting pad portion which surrounds a right shoulder and a right waist of the user, and the left and right supporting pad portions may be connected integrally and the left and right supporting pad portions may be hinged, in which a hinged portion may correspond to a backbone of the user.

A locking frame may be formed at the shoulder frames to prevent the shoulder frames respectively coupled with the back frames from being spaced apart.

The supporting pads may include frame guide members which are coupled with parts supporting the shoulder frames and include insertion grooves into which the shoulder frames are inserted to prevent the shoulder frames from being separated, and fixing holes may be formed in sides of the frame guide members, into which auxiliary frames are inserted.

The shoulder mounted pads may include elastic members coupled with the shoulder frames and shoulder mounted pad portions coupled with the elastic members to be elastically fixed to the shoulders of the user.

The back frames may be coupled with a plurality of divided backpacks, and the backpacks pivot from the back frames.

The backpacks may pivot from the back frames and another backpack may be inserted into a space between the backpacks.

First hinge portions may be formed at the back frames, and second hinge portions hinge-coupled with the first hinge portions may be formed at the supporting pads.

The supporting pads may include back pads which support the back of the user and shoulder pads which support the shoulders of the user.

The shoulder frames may include handles hinged-coupled with the shoulder frames.

The supporting pads may include shoulder frame locking devices in which storage spaces are formed and holding protrusions are formed and holding hooks inserted into the storage space of the shoulder frame locking devices and coupled with the holding protrusions to be fixed.

Advantageous Effects

According to embodiments of the present invention, a backpack frame device provides effects of increasing comfort for a user by distributing the load of a backpack using a frame instead of shoulder straps, correcting a posture of the user using the backpack, and coupling an additional backpack therewith by modifying a structure of the backpack.

MODE FOR INVENTION

Figure 1:
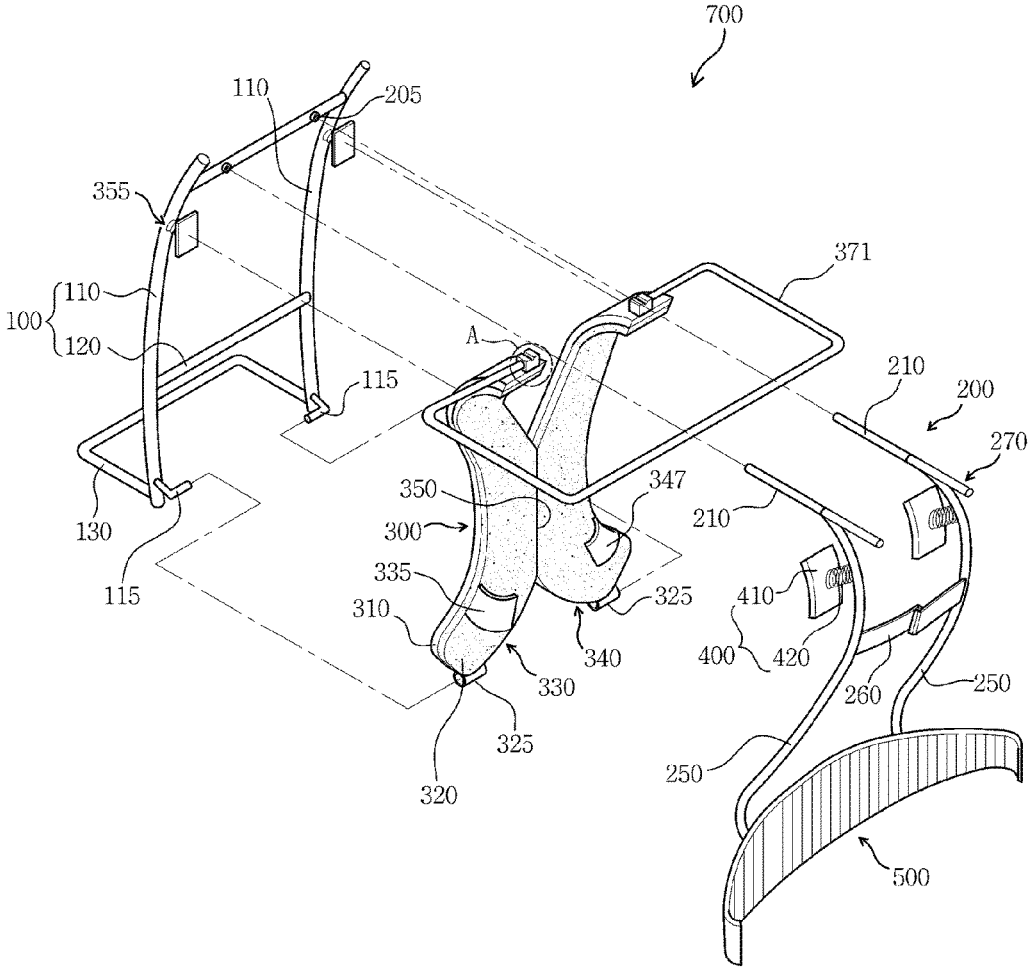
FIG. 1 is an exploded perspective view of a backpack frame device according to one embodiment of the present invention.

In a following description, only parts necessary for understanding the embodiments of the present invention will be described and a description of other parts will be omitted so as not to obscure the subject matters of the present invention.

Terms and words used in the present disclosure and claims should not be understood as being limited to general or lexical meanings. In an aspect that the inventor may properly define the concept of the terms in order to describe the embodiments of the present invention in the best way, the terms should be understood as meanings and concepts appropriate to the technical thought of the embodiments of the present invention. Accordingly, the embodiments disclosed in the specification and configurations illustrated in the drawings are merely exemplary embodiments, which do not represent the entire technical thought of the present invention. It should be understood various equivalents replaceable therefor and modified examples thereof may exist at the point in time of filing the present application.

Figure 2:
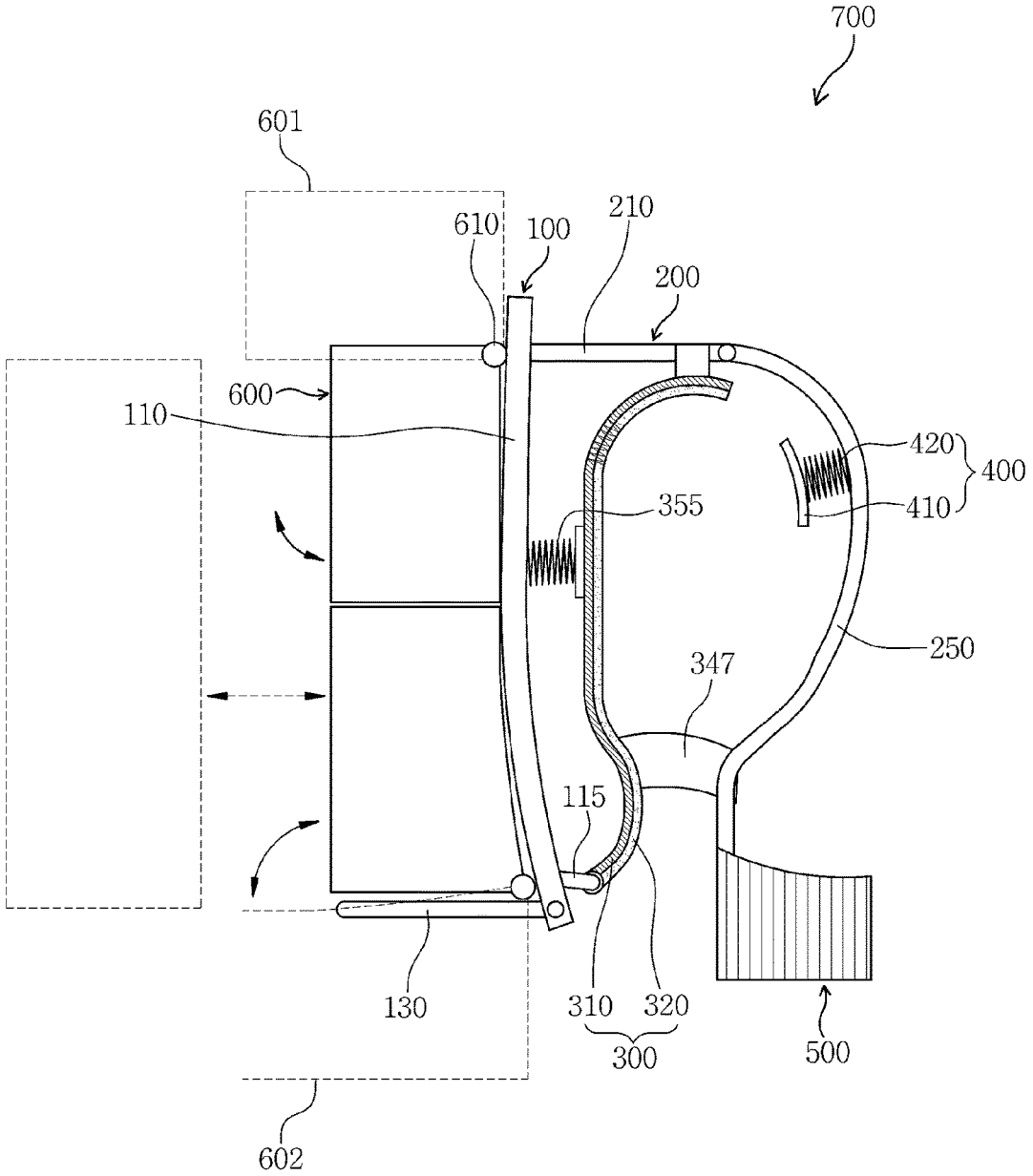
FIG. 2 is a cross-sectional view of the backpack frame device of FIG. 1.
Figure 3:
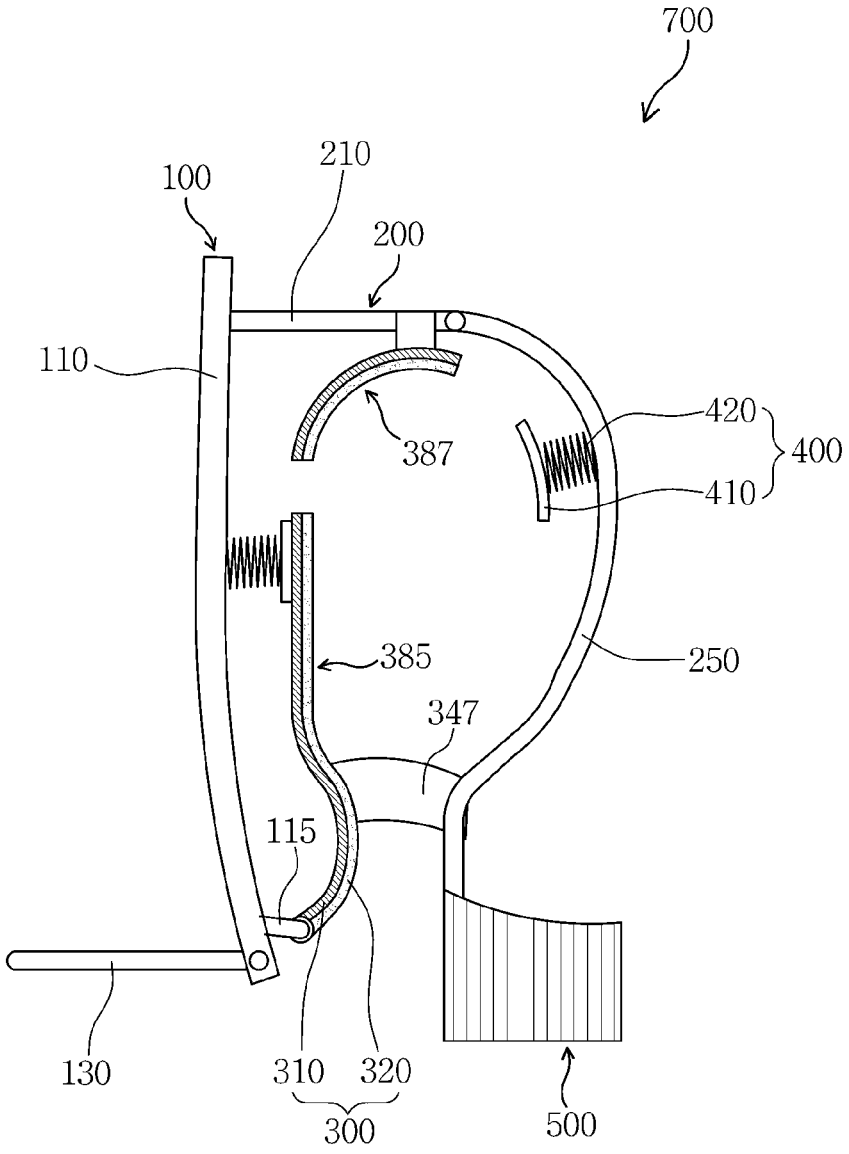
FIG. 3 is a cross-sectional view of another example of the backpack frame device of FIG. 1.
Figure 4:
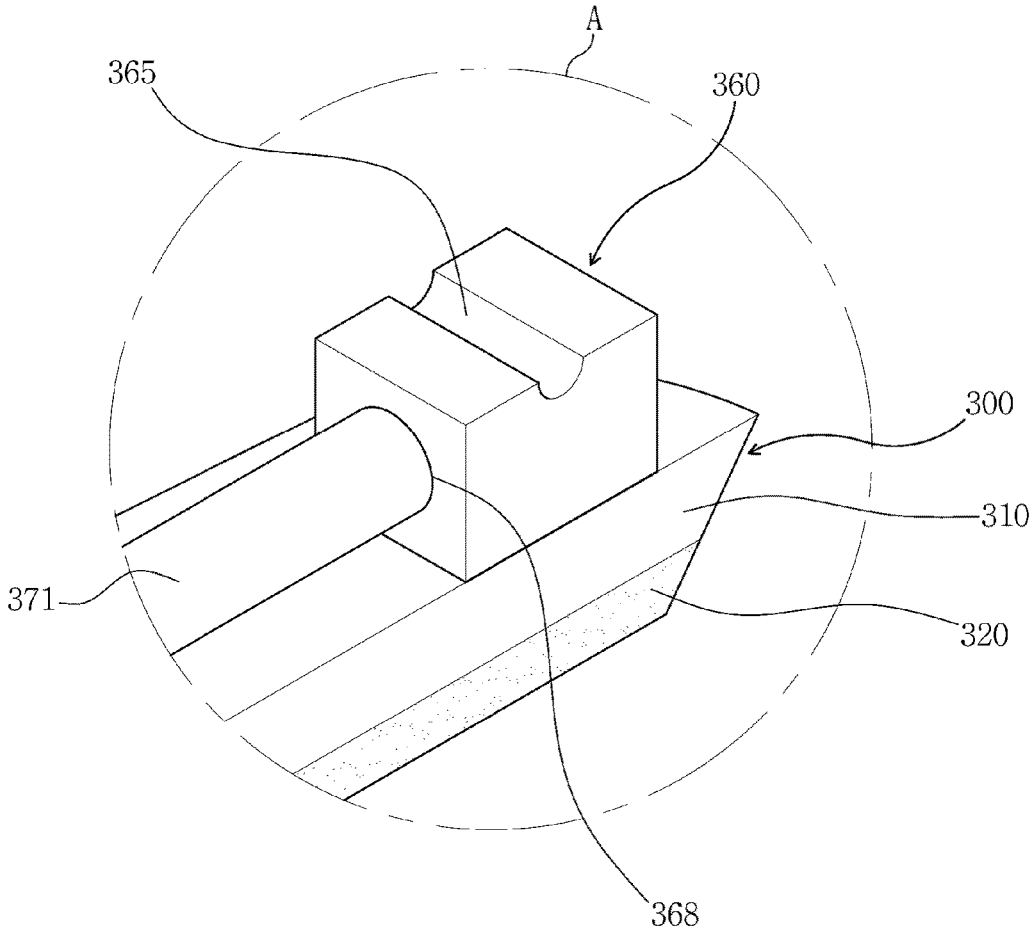
FIG. 4 is an enlarged view illustrating a portion 'A' shown in FIG. 1.
Figure 5:
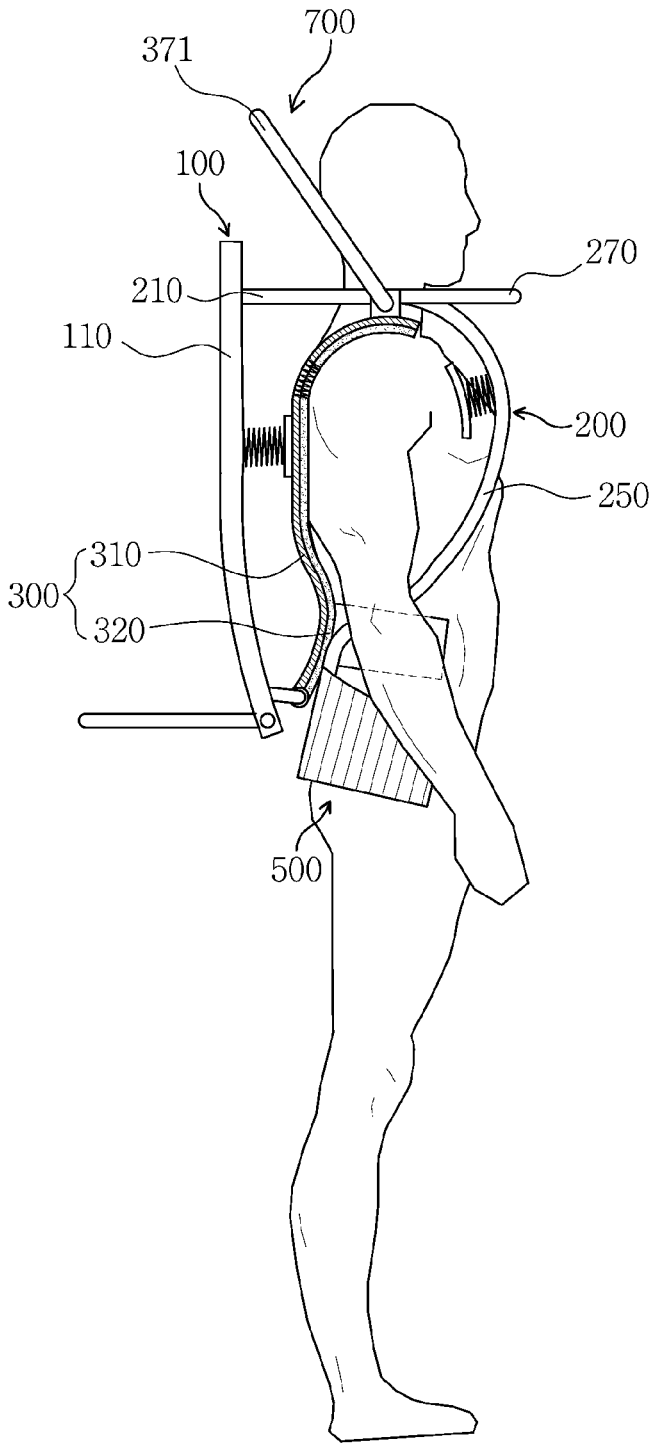
FIG. 5 is a side view illustrating a state in which the backpack frame device of FIG. 1 is mounted on the user's back.
Figure 6:
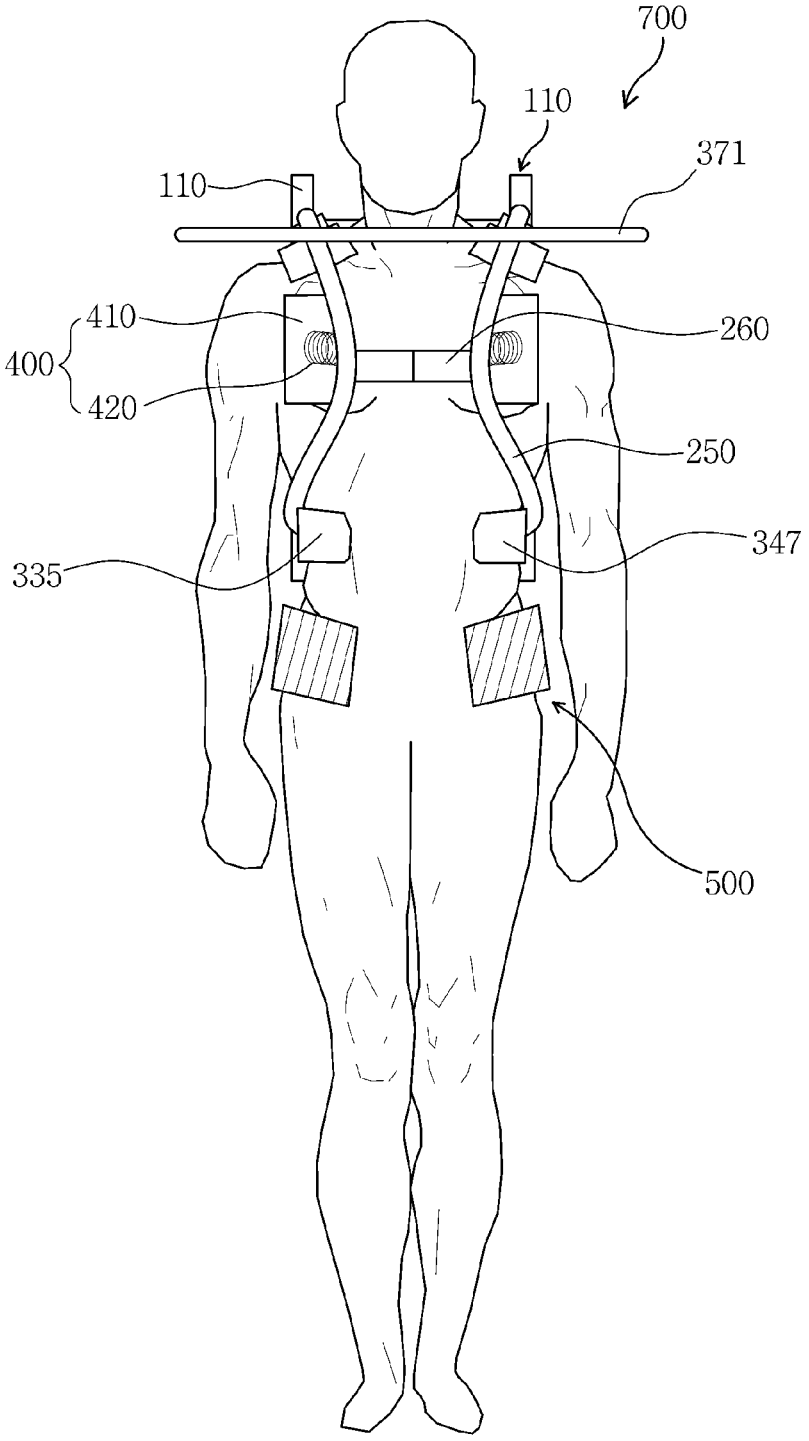
FIG. 6 is a front view illustrating a state in which the backpack frame device of FIG. 1 is mounted on the user's back.
Figure 7:
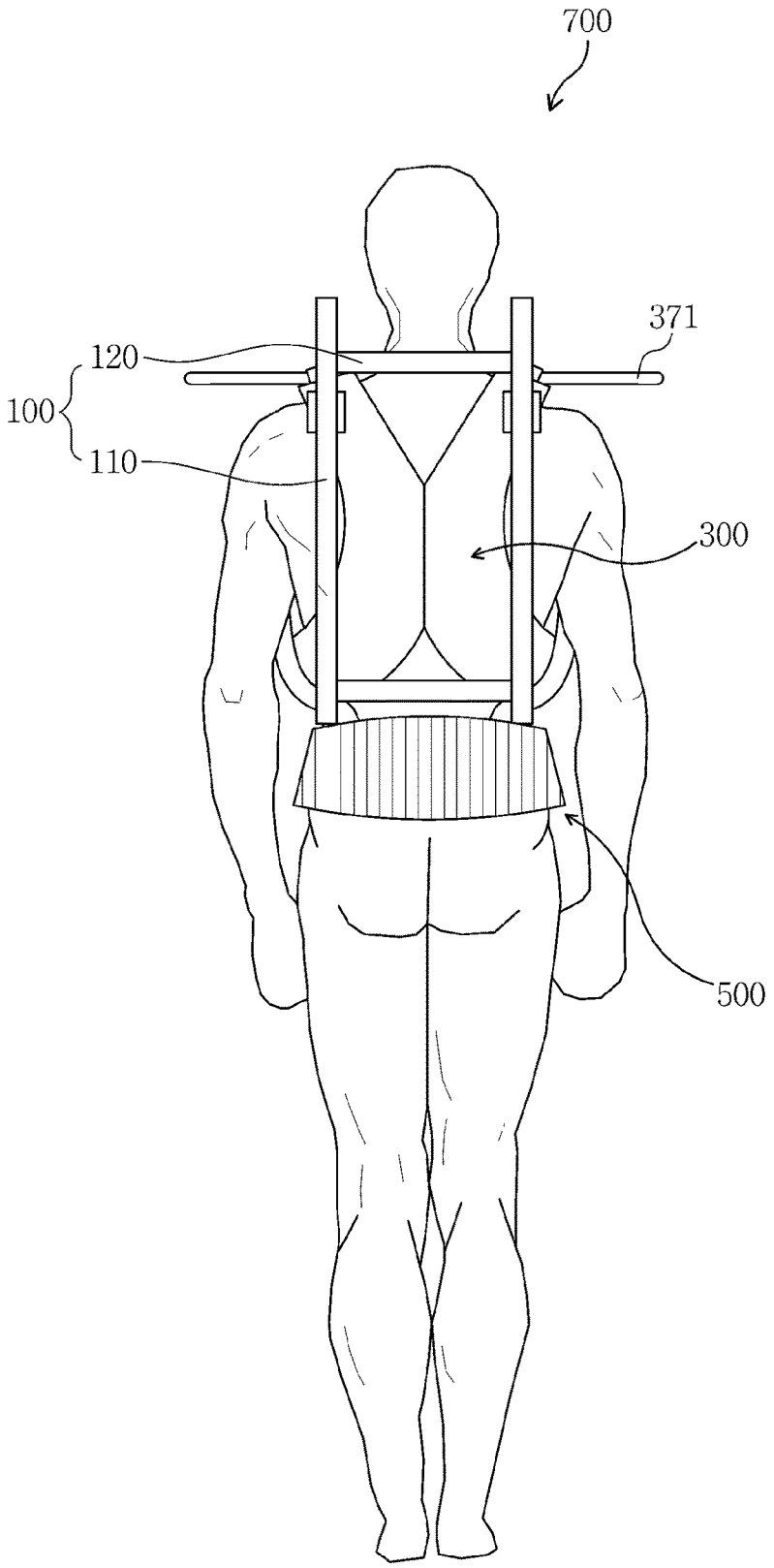
FIG. 7 is a rear view illustrating a state in which the backpack frame device of FIG. 1 is mounted on the user's back.

FIG. 1 is an exploded perspective view of a backpack frame device according to one embodiment of the present invention. FIG. 2 is a cross-sectional view of the backpack frame device of FIG. 1. FIG. 3 is a cross-sectional view of another example of the backpack frame device of FIG. 1. FIG. 4 is an enlarged view illustrating portion 'A' shown in FIG. 1. FIG. 5 is a side view illustrating a state in which the backpack frame device of FIG. 1 is mounted on the user's back. FIG. 6 is a front view illustrating a state in which the backpack frame device of FIG. 1 is mounted on the user's back. FIG. 7 is a rear view illustrating a state in which the backpack frame device of FIG. 1 is mounted on the user's back.

Referring to FIGS. 1 to 7, a backpack frame device 700 includes back frames 100, shoulder frames 200, supporting pads 300, shoulder mounted pads 400, and a lumbar support 500.

The back frames 100 are mutually connected while being mutually spaced apart and support a backpack.

The back frames 100 include first back frames 110 and second back frames 120. In addition, the back frames 100 may further include a backpack support 130.

The first back frames 110, for example, number two and are longitudinally formed. Although the number of the first back frames 110 is two in one embodiment of the present invention, the number of first back frames 110 may be at least three.

The first back frames 110 may be lengthwise formed from a waist portion of the user to a top of the user's head. Particularly, portions near the top of the head may be bent forward.

The second back frames 120 connect the first back frames 110 with each other, and for example, are formed widthwise.

The number of second back frames 120 formed, for example, may be at least one, and preferably, may be a plurality.

The back frames 100 which include the first and second back frames 110 and 120 may be manufactured using an aluminum alloy which is light and has high strength or a high strength plastic. The back frames 100 may have a hollow pipe shape or a solid bar shape.

The backpack support 130 may be coupled to lower outer sides of the first back frames 110 of the back frames 100. The backpack support 130 is pivotably coupled with the back frames 100.

Since the backpack support 130 is pivotably coupled with the back frames 100, the backpack support 130 may be unfolded from the back frames 100 to support the backpack when mounting the backpack and may be folded toward the back frames 100 to be stored.

The shoulder frames 200 are coupled with the back frames 100 and the lumbar support 500 that will be described below.

One end of the shoulder frame 200 is coupled with the back frame 100 and the other end opposite to the one end extends over the shoulders of the user toward the waist of the user. The other end of the shoulder frame 200 may extend toward the side or the back of the waist of the user.

The shoulder frames 200 may be manufactured using an aluminum alloy which is light and has high strength or a high strength plastic. The shoulder frame 200 may have a hollow pipe shape or a solid bar shape.

The shoulder frame 200 includes a first shoulder frame 210 and a second shoulder frame 250. The first and second shoulder frames 210 and 250 are mutually hinge-coupled.

The first shoulder frames 210 are coupled with a pair of the second back frames 120 of the back frames 100, respectively.

Although the first shoulder frames 210 are coupled with the second back frames 120 in one embodiment of the present invention, the first shoulder frames 210 may be coupled with the first back frames 110.

In one embodiment of the present invention, the first shoulder frames 210 are coupled with the pair of the second back frames 120 through ball-hinge structures 205.

For example, concave hinge grooves may be formed in the second back frames 120, and balls to be inserted into the hinge grooves may be mounted on the shoulder frames 210. When it is difficult to form the concave hinge grooves in the second back frames 120, hinge blocks having concave hinge grooves may be additionally mounted on the second back frames 120.

When the second back frames 120 and the first shoulder frames 210 are coupled using the ball-hinge structures 205, the first shoulder frames 210 may freely pivot in a preferable direction.

The second shoulder frames 250 may be hinge-coupled with ends of the first shoulder frames 210, and ball-hinge structures may be formed at the second shoulder frames 250 and the first shoulder frames 210.

For example, concave hinge grooves may be formed on the ends of the first shoulder frames 210 and balls to be inserted into the hinge grooves may be mounted on the second shoulder frames 250.

As the second shoulder frames 250 are ball-hinge-coupled with the ends of the first shoulder frames 210, the second shoulder frames 250 may freely pivot from the first shoulder frames 210.

The second shoulder frames 250 coupled with the first shoulder frames 210 are bent downward from the first shoulder frames 210 and extend toward the side or back of the waist of the user.

In one embodiment of the present invention, handles 270 are coupled with the first shoulder frames 210 or the second shoulder frames 250.

In one embodiment of the present invention, the handles 270, for example, may be coupled with the shoulder frames 200. The handles 270 may be hinge-coupled with the shoulder frames 200 to be folded to or unfolded from the shoulder frames 200. The handles 270 may be detachably coupled with the shoulder frames 200. The handles 270 may be coupled with the first shoulder frames 210 or the second shoulder frames 250.

The user may be able to hold the handles 270 using his/her hands by unfolding the handles 270 hinge-coupled with the second shoulder frames 250 while walking.

Although the handles 270 are coupled with the second shoulder frames 250 in one embodiment of the present invention, the handles 270 may be coupled with the first shoulder frames 210.

Meanwhile, when the ball-hinge structures are formed at the first and second shoulder frames 210 and 250, the first and second shoulder frames 210 and 250 may be spaced apart. To prevent this, the first and second shoulder frames 210 and 250 may be coupled with a locking frame 260. The locking frame 260 is coupled with the first and second shoulder frames 210 and 250 to mutually lock or release the first and second shoulder frames 210 and 250 from one another.

In one embodiment, the first and second shoulder frames 210 and 250 of the shoulder frame 200 may include structures capable of adjusting lengths thereof in consideration of body sizes of the user, for example, a chest size and a shoulder width.

The supporting pads 300 support the back and shoulders of the user. The supporting pads 300 are coupled with the back frames 100 and the shoulder frames 200.

In one embodiment of the present invention, the supporting pads 300 are coupled with the back frames 100 and the shoulder frames 200, thereby distributing the load on the user.

Referring to FIGS. 1 and 2, bottoms of the supporting pads 300 are hinge-coupled with the bottoms of the first back frames 110 of the back frames 100. The bottoms of the first back frames 110 and the bottoms of the supporting pads 300 are mutually hinge-coupled, thereby allowing the first back frames 110 to pivot on the supporting pads 300.

The supporting pads 300 include first supporting pad portions 310 and second supporting pad portions 320.

The first supporting pad portions 310 are coupled with the first back frames 110 of the back frames 100. The first supporting pad portions 310 are formed of a solid material which is not deformed by an external force. For example, the first supporting pad portions 310 may be manufactured using a composite resin or metal. The first supporting pad portions 310 are formed to support the back of the user while surrounding a left shoulder, a left waist, a right shoulder, and right waist of the user.

The second supporting pad portions 320 are formed in a shape similar to the first supporting pad portions 310. The second supporting pad portions 320 are formed on inner surfaces of the first supporting pad portions 310.

The second supporting pad portions 320 may be formed of a material having excellent cushioning properties appropriate for absorbing a shock. In one embodiment of the present invention, the second supporting pad portions 320 may include elastic members or foam members.

The supporting pads 300 which include the first and second supporting pad portions 310 and 320 formed in double structures are formed as a symmetrical shape. The supporting pads 300 formed of the double structures include a left supporting pad 330 and a right supporting pad 340 when viewed in a plane.

The left supporting pad 330 surrounds and supports the left shoulder, a left back, and the left waist of the user. The right supporting pad 340 surrounds and supports the right shoulder, a right back, and the right waist of the user.

First hinge portions 325 are formed at a bottom of the left supporting pad 330 and a bottom of the right supporting pad 340, respectively. Second hinge portions 115 for coupling with the first hinge portions 325 are formed at the bottoms of the first back frames 110.

For example, the hinge portions 325 formed at the bottoms of the left and right supporting pads 330 and 340 may have a pipe shape. The second hinge portions 115 formed at the bottoms of the first back frames 110 may have a shaft shape to be inserted into the first hinge portions.

Meanwhile, in a middle space between the left supporting pad 330 and the right supporting pad 340, a hinge portion 350 is formed to hinge-couple the left and right supporting pads 330 and 340.

The hinge portion 350 corresponds to a backbone of the user. The left supporting pad 330 is closely attached to the left back based on the backbone of the user, and the right supporting pad 340 is closely attached to the right back based on the backbone of the user.

The hinge portion 350 is formed on the supporting pads 300 to allow that the left supporting pad 330 and the right supporting pad 340 to be supported by the hinge portion?? in this way, that the supporting pads 300 are strongly contact the back of the user and simultaneously the shoulder mounted pads 400 that will be described below strongly pressurizes both shoulders of the user, thereby correcting a walking posture of the user to prevent or minimize a sore back or spinal damage.

A left waist fixing portion 335 which fixes the left waist of the user is formed on the left supporting pad 330, and a right waist fixing portion 347 which fixes the right waist of the user is formed on the right supporting pad 340.

In one embodiment, hinge portions which allow the back and the shoulder to be smoothly moved are formed at a portion of the left supporting pad 330, where the back and the shoulder of the user are connected, and a portion of the right supporting pad 340, where the back and the shoulder of the user are connected, respectively.

In one embodiment, the backpack frame device 700 further includes buffer members 355. One end of the buffer member 355 is connected to an outer surface of the first supporting pad portion 310 of the supporting pad 300 and the other end opposite to the one end is coupled with the back frame 100.

The buffer members 355 may have an elastic strap, coil, spring, or plate spring shape. The buffer members 355 absorb a shock or vibrations applied to the supporting pads 300 to minimize the shock or vibrations applied to the supporting pads 300.

The buffer member 355 not only absorbs the shock or vibrations applied to the supporting pad 300 but also prevents the back frame 100 from excessively pivoting from the supporting pad 300.

Although the supporting pads 300 described above have a structure in which portions supporting the shoulders and back of the user are integrated, as shown in FIG. 3, the supporting pads 300 may be divided into back pads 385 which support the back of the user and shoulder pads 387 which support the shoulders of the user.

When the supporting pads 300 are divided into the back pads 385 and the shoulder pads 387 as shown in FIG. 3, the load on the shoulders and back of the user is distributed again in such a way that the user may more freely move the shoulders and back.

FIG. 4 is an enlarged view illustrating a portion 'A' shown in FIG. 1.

Referring to FIGS. 1 and 4, the supporting pads 300 include frame guide members 360.

The frame guide members 360 are formed at portions of the outer surfaces of the first supporting pad portions 310 of the supporting pads 300, which support the left shoulder and the right shoulder, respectively. The frame guide members 360 support and guide the first shoulder frames 210.

The frame guide members 360 prevent the first shoulder frames 210 of the shoulder frames 200 ball-hinge-coupled with the back frames 100 from arbitrarily pivoting.

The frame guide members 360 may have a block shape. The frame guide members 360 may be manufactured using a composite resin which is light and has high strength.

Block-shaped bottom surfaces of the frame guide members 360 are fixed to the supporting pads 300. Insertion grooves 365 for supporting and guiding the first shoulder frames 210 are formed in top surfaces of the frame guide members 360. The insertion grooves 365 have spaces suitable for allowing the first shoulder frames 210 to be inserted therein.

Since the first shoulder frames 210 are placed on the frame guide members 360, the load of the backpack may be distributed again, thereby reducing the fatigue of the user and preventing the posture of the user from going awry.

Fixing holes 368 are formed in outer surfaces of the frame guide members 360, and an auxiliary frame 371 on which an auxiliary pouch or bag is mounted is inserted in the fixing holes 368.

The auxiliary frame 371 has a shape formed by bending a metal wire having adequate rigidity at least three times. Both ends of the auxiliary frame 371 are coupled with the fixing holes 368 formed in the frame guide members 360.

Generally, the auxiliary frame 371 may be disposed at the rear of a user's head. In order to use the auxiliary pouch and the like, the user may pivot the auxiliary frame 371 forward.

As described above, when the auxiliary pouch is mounted on the auxiliary frame 371, since it is possible to store frequently used objects in the auxiliary pouch and to use the auxiliary pouch by pivoting the auxiliary frame 371, it is unnecessary to open the backpack placed on the back frames 100.

The shoulder mounted pads 400 are coupled with the shoulder frames 200, strongly elastically pressurize the both shoulders of the user elastically to correct the posture of the user while the waist and back of the user are being closely attached to the supporting pads 300, and reduce the fatigue of the user in a state of carrying the backpack for a long time.

The shoulder mounted pads 400 may be coupled with the first shoulder frames 210 or the second shoulder frames 250

In one embodiment of the present invention, the shoulder mounted pads 400 are coupled with the first shoulder frames 210.

The shoulder mounted pads 400 include shoulder mounted pad portions 410 and elastic members 420.

The shoulder mounted pad portions 410 have a curved pad shape in contact with the shoulders of the user along curves thereof.

One end of the elastic member 420 is coupled with the shoulder mounted pad portion 410, and other end opposite to the one end is coupled with the first shoulder pad portion 210 of the shoulder frame 200.

In one embodiment, the elastic members 420 may be formed of various types such as a coil, spring, and plate spring which generate an elastic force. Particularly, the shoulder mounted pad 400 may further include an elastic force adjusting member to allow the user to adjust a force which pressurizes the shoulders of the user.

Referring to FIGS. 1 and 2, the lumbar support 500 is coupled with ends of the second shoulder frames 250 of the shoulder frames 200.

In one embodiment, the lumbar support 500 is manufactured using a material having rigidity sufficient for supporting the waist of the user and may be formed connecting a plurality of pieces to be modified according to a waist size of the user.

In one embodiment, the lumbar support 500 is coupled with the two second shoulder frames 250 and may include pockets for accommodating the second shoulder frames 250.

Alternatively, the number of the lumbar supports 500 may be two to be coupled with the two second shoulder frames 250, respectively. Buckles for locking both ends of the lumbar support 500 may be mounted on the lumbar support 500.

Referring to FIG. 2, a backpack 600 mounted on the back frames 100 may be strongly fixed to the back frames 100 using straps and the like.

In one embodiment, one backpack 600 may be coupled with the back frames 100. However, a plurality of backpacks 600 may be coupled with the back frames 100.

When the plurality of backpacks 600 are coupled with the back frames 100, a rear upper end of each of the backpacks 600 may be hinge-coupled with the back frames 100.

When the rear upper end of the backpack 600 is hinge-coupled with the back frames 100, a backpack 601 disposed above and a backpack 602 disposed below may be pivoted in different directions based on a hinge 610, respectively.

As described above, when the backpack 601 disposed above and the backpack 602 disposed below are pivoted in different directions from the back frames 100, an empty space is formed at the back frames 100 due to the pivoting of the backpacks 601 and 602. Another backpack 603 is inserted into the empty space and is fixed to the back frames 100.

As described above, the plurality of backpacks 601 and 602 are fixed to the back frames 100 and pivoted in different directions, respectively, in such a way that a space is formed and another backpack is inserted into the space, thereby efficiently arranging the space and backpacks fixed to the back frames 100.

The backpack frame device 700 shown in FIGS. 1 to 7 is appropriate for fixing and carrying heavy backpacks during trekking in the mountains.

Hereinafter, a backpack frame device for storing relatively lighter objects therein will be described with reference to FIGS. 8 to 9.

Figure 8:
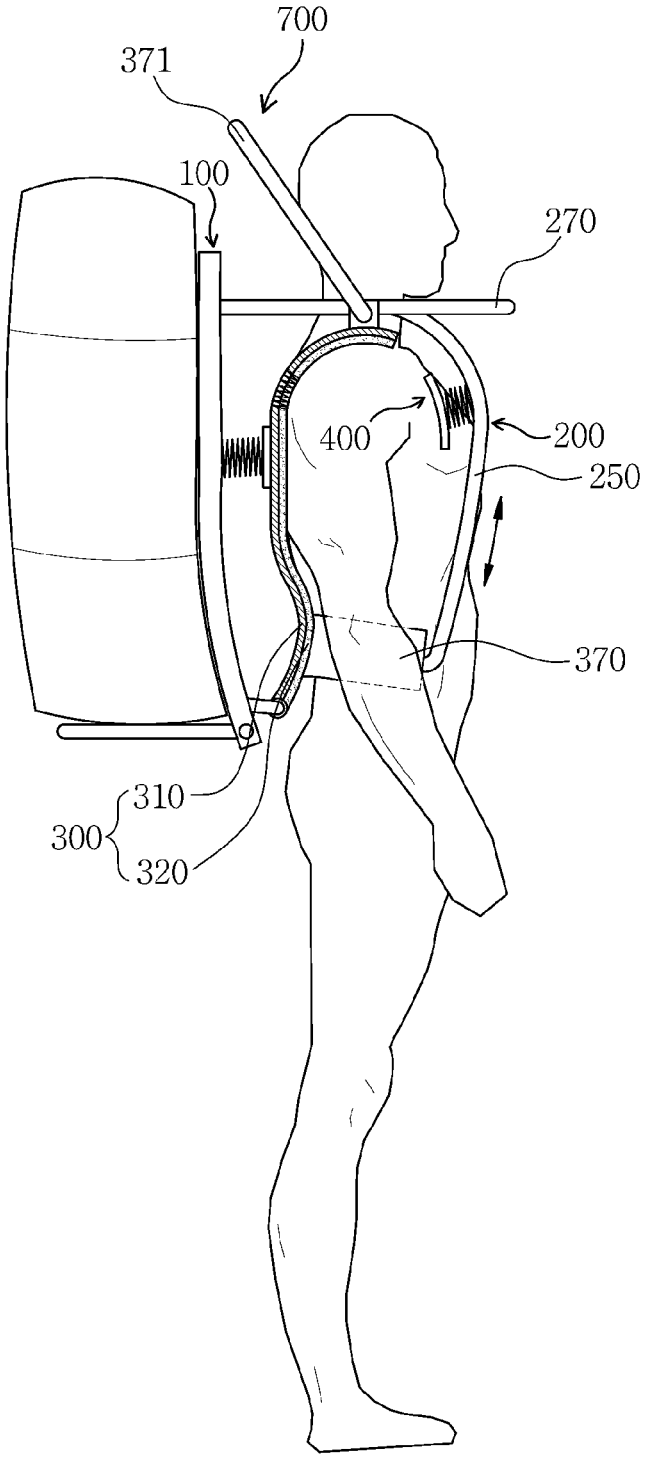
FIG. 8 is a side cross-sectional view of a lightweight backpack frame device according to one embodiment of the present invention.

FIG. 8 is a side cross-sectional view of a lightweight backpack frame device according to one embodiment of the present invention. FIG. 9 is a cross-sectional view of a shoulder frame fixing device of FIG. 8. The lightweight backpack frame device 800 shown in FIGS. 8 and 9 has a configuration substantially identical to the backpack frame device 700 shown in FIGS. 1 to 7 except the shoulder frames 200 and shoulder frame locking devices 370. Accordingly, a repetitive description of the same element will be omitted and like reference numerals designate like elements.

Figure 9:
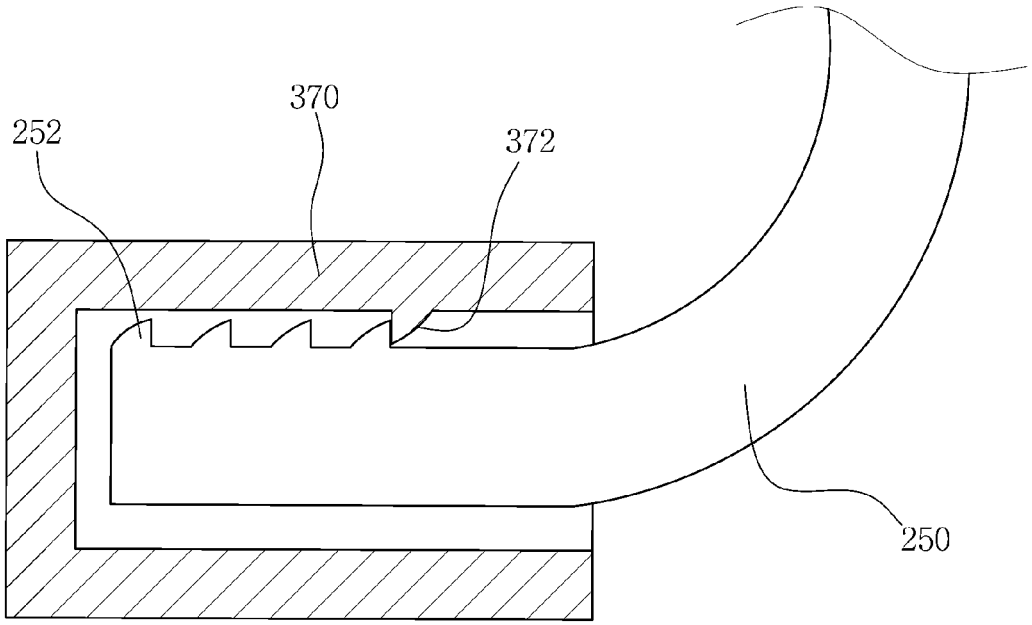
FIG. 9 is a cross-sectional view of a shoulder frame fixing device of FIG. 8.

Referring to FIGS. 8 to 9, the backpack frame device 800 includes the back frames 100, the shoulder frames 200, the supporting pads 300, the shoulder mounted pads 400, and shoulder frame locking devices 370.

A plurality of holding hooks 252 are formed at the ends of the second shoulder frames 250 of a pair of the shoulder frames 200 coupled with the back frames 100 and are coupled with the shoulder frame locking devices 370 which will be described below.

The shoulder frame locking devices 370 are formed at or coupled with the left waist fixing portion 335 formed on the left supporting pad 330 and the right waist fixing portion 347 formed on the right supporting pad 340, respectively.

The shoulder frame locking devices 370 formed at the left waist fixing portion 335 and the right waist fixing portion 347, respectively, may be formed of a composite resin or metal material and have a container shape which accommodates each of the holding hooks 252 of the second shoulder frames 250.

Holding protrusions 372 which are coupled with or released from the holding hooks 252 formed at the second shoulder frames 250 are formed inside the shoulder frame locking devices 370.

As the user pulls the second shoulder frames 250, the holding hooks 252 formed at the ends of the second shoulder frames 250 are inserted into the shoulder frame locking devices 370, thereby coupling and locking the holding hooks 252 with the holding protrusions 372 formed inside the shoulder frame locking devices 370.

As the holding protrusions 372 and the holding hooks 252 are locked with one another, the shoulder mounted pads 400 are strongly contact the shoulders of the user. As the shoulder mounted pads 400 are strongly contact the shoulders of the user, the back of the user is strongly attached to the supporting pads 300, thereby straightening the backbone of the user. Accordingly, the user may walk in a correct posture.

Although the second shoulder frames 250 are coupled with the shoulder frame locking devices 370 using the holding hooks 252 and the holding protrusions 372 in one embodiment of the present invention, various coupling and releasing devices may be used.

According to the described above, there are provided effects of increasing comfort for a user by distributing the load of a backpack using a frame instead of shoulder straps, correcting a posture of the user using the backpack, and coupling an additional backpack therewith by modifying a structure of the backpack.

While one or more embodiments of the present invention have been described with reference to the figures, it will be understood by those of ordinary skill in the art that various changes in form and details may be made therein without departing from the spirit and scope of the present invention as defined by the following claims.

INDUSTRIAL APPLICABILITY

The present invention may be applicable to the field of backpacks on which loads may be placed and backpack frames coupled with backpacks.

The invention claimed is:

1. A backpack frame device comprising:

back frames mutually spaced apart and connected;

shoulder frames which comprise one ends coupled with the back frames and the other ends extending over shoulders of a user toward a rear of the waist of the user;

supporting pads which are hinge-coupled with bottom ends of the back frames and comprise top ends opposite to the bottom ends and configured to support parts of the shoulder frames;

shoulder mounted pads which are coupled with the shoulder frames and elastically pressurize both shoulders of the user; and a lumbar support which is coupled with the bottom ends of the shoulder frames and supports the rear of the waist of the user.

2. The backpack frame device of claim 1, further comprising buffer members whose one ends are coupled with the supporting pads and the other ends opposite to the one ends are coupled with the back frames.

3. The backpack frame device of claim 1, wherein the shoulder frames comprise first shoulder frames hinge-coupled with the back frames and second shoulder frames hinge-coupled with the first shoulder frames, and the second shoulder frames are coupled with the lumbar support.

4. The backpack frame device of claim 1, wherein the supporting pads comprise first supporting pad portions coupled with the back frames and second supporting pad portions formed on parts of the first supporting pad portions and in contact with the back to provide cushioning properties.

5. The backpack frame device of claim 1, wherein the supporting pads comprise a left supporting pad portion which surrounds a left shoulder and a left waist of the user and a right supporting pad portion which surrounds a right shoulder and a eight waist of the user, and wherein the left and right supporting pad portions are connected integrally and the left and right supporting pad portions are hinged, in which a hinged portion corresponds to a backbone of the user.

6. The backpack frame device of claim 1, wherein a locking frame is formed at the shoulder frames to prevent the shoulder frames respectively coupled with the back frames from being spaced apart.

7. The backpack frame device of claim 1, wherein the supporting pads comprise frame guide members which are coupled with parts supporting the shoulder frames and comprise insertion grooves in which the shoulder frames are inserted to prevent the shoulder frames from being separated, and wherein fixing holes are formed in sides of the frame guide members and into which auxiliary frames are inserted.

8. The backpack frame device of claim 1, wherein the shoulder mounted pads comprise elastic members coupled with the shoulder frames and shoulder mounted pad portions coupled with the elastic members to be elastically fixed to the shoulders of the user.

9. The backpack frame device of claim 1, wherein the back frames are coupled with a plurality of divided backpacks, and the backpacks pivot from the back frames.

10. The backpack frame device of claim 9, wherein the backpacks pivot from the back frames and another backpack is inserted into a space between the backpacks.

11. The backpack frame device of claim 1, wherein first hinge portions are formed at the back frames, and second hinge portions for hinge-coupling with the first hinge portions are formed at the supporting pads.

12. The backpack frame device of claim 1, wherein the supporting pads comprise back pads which support the back of the user and shoulder pads which support the shoulders of the user.

13. The backpack frame device of claim 1, wherein the shoulder frames comprise handles hinged-coupled with the shoulder frames.

14. The backpack frame device of claim 1, wherein the supporting pads comprise shoulder frame locking devices in which storage spaces are formed and holding protrusions are formed, and wherein holding hooks are inserted into the storage spaces of the shoulder frame locking devices and coupled with the holding protrusions to be fixed.

* * * * *